US011345566B2

(12) United States Patent
Stanley et al.

(10) Patent No.: US 11,345,566 B2
(45) Date of Patent: May 31, 2022

(54) ELEVATOR CAR ROUTE SELECTOR

(71) Applicant: Otis Elevator Company, Farmington, CT (US)

(72) Inventors: Jannah A. Stanley, Portland, CT (US); Arthur Hsu, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 965 days.

(21) Appl. No.: 16/100,381

(22) Filed: Aug. 10, 2018

(65) Prior Publication Data

US 2020/0031613 A1 Jan. 30, 2020

Related U.S. Application Data

(60) Provisional application No. 62/711,797, filed on Jul. 30, 2018.

(51) Int. Cl.
*B66B 1/24* (2006.01)

(52) U.S. Cl.
CPC ..... *B66B 1/2466* (2013.01); *B66B 2201/103* (2013.01); *B66B 2201/212* (2013.01); *B66B 2201/221* (2013.01); *B66B 2201/222* (2013.01); *B66B 2201/23* (2013.01)

(58) Field of Classification Search
CPC ..... B66B 1/2466; B66B 2201/103; B66B 2201/212; B66B 2201/221; B66B 2201/222; B66B 2201/23; B66B 2201/104; B66B 2201/4615; B66B 2201/4653; B66B 1/2408; B66B 3/006; B66B 1/468; B66B 9/00; B66B 1/06; B66B 2009/006
See application file for complete search history.

(56) References Cited

U.S. PATENT DOCUMENTS 5,719,360 A * 2/1998 Davis ..... B66B 1/20 187/380
6,655,501 B2 12/2003 Kostka
7,377,364 B2 5/2008 Tyni et al.
7,694,781 B2 4/2010 Sorsa et al.
(Continued)

FOREIGN PATENT DOCUMENTS

CN 107289923 A 10/2017
WO 2008043877 4/2008
(Continued)

OTHER PUBLICATIONS

Chinese First Office Action; dated Aug. 31, 2020; Application No. CN 201910689108.9; 24 pages.
(Continued)

*Primary Examiner* — Jeffrey Donels
(74) *Attorney, Agent, or Firm* — Cantor Colburn LLP

(57) ABSTRACT

According to an aspect, a method includes receiving a passenger request to reserve an elevator car of an elevator system to travel to a targeted destination. At least two different travel options to the targeted destination are determined based on a plurality of elevator car travel plans comprising at least two elevator cars having different travel ranges. The at least two different travel options are output to an interactive display. At least one of the at least two elevator cars is reserved responsive to a user selection of one of the at least two different travel options.

20 Claims, 4 Drawing Sheets

(56) References Cited

U.S. PATENT DOCUMENTS

| | | | | |
|---|---|---|---|---|
| 9,561,932 | B2 | 2/2017 | Salmikuukka et al. | |
| 9,896,305 | B2 | 2/2018 | Blandin et al. | |
| 10,266,370 | B2 * | 4/2019 | Muncy | B66B 3/006 |
| 10,302,440 | B2 | 5/2019 | Zhang | |
| 10,351,386 | B2 * | 7/2019 | Peterson | B66B 1/468 |
| 10,486,938 | B2 * | 11/2019 | Baldi | B66B 1/468 |
| 10,589,960 | B2 * | 3/2020 | Simcik | G06F 3/04883 |
| 10,875,742 | B2 * | 12/2020 | Scoville | B66B 1/468 |
| 10,947,085 | B2 * | 3/2021 | Nichols | B66B 1/2408 |
| 10,947,086 | B2 * | 3/2021 | Nichols | B66B 1/2408 |
| 10,988,345 | B2 * | 4/2021 | Scoville | H04W 4/33 |
| 2017/0217727 | A1 | 8/2017 | Scoville et al. | |
| 2017/0260023 | A1 | 9/2017 | Zhang | |
| 2017/0267487 | A1 | 9/2017 | Pasini et al. | |
| 2017/0284813 | A1 * | 10/2017 | Zhang | G01C 21/206 |
| 2017/0291795 | A1 * | 10/2017 | Scoville | B66B 1/2408 |
| 2017/0313546 | A1 * | 11/2017 | King | B66B 9/003 |
| 2018/0118509 | A1 | 5/2018 | Simcik et al. | |
| 2018/0118510 | A1 | 5/2018 | Simcik et al. | |
| 2018/0118511 | A1 * | 5/2018 | Baldi | G06F 3/04883 |
| 2018/0282113 | A1 * | 10/2018 | Simcik | B66B 1/468 |

FOREIGN PATENT DOCUMENTS

| | | |
|---|---|---|
| WO | 2009122002 | 10/2009 |
| WO | 2012093985 | 7/2012 |

OTHER PUBLICATIONS

EP Application No. 19189224.9 Extended EP Search Report dated Feb. 19, 2020, 7 pages.

* cited by examiner

ELEVATOR CAR ROUTE SELECTOR

CROSS-REFERENCE TO RELATED APPLICATION

This application claims the benefit of priority to U.S. Provisional Application No. 62/711,797 filed Jul. 30, 2018, the disclosure of which is incorporated herein by reference in its entirety.

BACKGROUND

The embodiments herein relate to elevator systems, and more particularly to an elevator car route selector for an elevator system.

Commonly, very tall buildings (e.g., high rises or sky scrapers) include sky lobbies or transfer floors, which are intermediate interchange (i.e., transfer) floors where passengers may transfer from an elevator serving an upper portion of the building to an elevator serving a lower portion of the building. Buildings may include multiple groups of elevators, including some that run the full length of a building and others that bypass certain floors. When there are multiple possible routes to reach a desired destination floor, it can be challenging to efficiently identify a preferred route for various passengers that may desire different destination floors at similar times.

BRIEF SUMMARY

According to an embodiment, a method of providing an elevator car route selector includes receiving a passenger request to reserve an elevator car of an elevator system to travel to a targeted destination. At least two different travel options to the targeted destination are determined based on a plurality of elevator car travel plans comprising at least two elevator cars having different travel ranges. The at least two different travel options are output to an interactive display. At least one of the at least two elevator cars is reserved responsive to a user selection of one of the at least two different travel options.

In addition to one or more of the features described herein, or as an alternative, further embodiments include determining an estimated travel time for each of the at least two different travel options, and outputting the estimated travel time for each of the at least two different travel options to the interactive display.

In addition to one or more of the features described herein, or as an alternative, further embodiments include where the estimated travel time is a route travel time that incorporates an estimated transfer time between two or more of the elevator cars on a transfer floor.

In addition to one or more of the features described herein, or as an alternative, further embodiments include where the estimated travel time incorporates an estimated travel time from a data entry location to an elevator entry point for each of the at least two different travel options.

In addition to one or more of the features described herein, or as an alternative, further embodiments include where the estimated travel time incorporates an estimated arrival time of an elevator car at an elevator entry point for each of the at least two different travel options.

In addition to one or more of the features described herein, or as an alternative, further embodiments include prompting for a user input of a number of passengers associated with the passenger request, and selecting the at least two different travel options based on an expected capacity to accommodate the number of passengers.

In addition to one or more of the features described herein, or as an alternative, further embodiments include transferring a sequence of instructions to a mobile device associated with the passenger request based on the user selection of one of the at least two different travel options, and updating an estimated arrival time at the targeted destination on the mobile device as a user of the mobile device progresses.

In addition to one or more of the features described herein, or as an alternative, further embodiments include updating at least one of the elevator car travel plans of the at least one elevator car associated with the user selection.

In addition to one or more of the features described herein, or as an alternative, further embodiments include where the elevator car travel plans include a list of planned stops, stop times, travel times, and a number of passengers expected to enter and exit at each of the planned stops.

In addition to one or more of the features described herein, or as an alternative, further embodiments include where the at least two different travel options are identified based on minimizing one or more changes to estimated travel times provided to one or more previously reserved passengers and/or anticipated delays due to time of day/congestion.

According to an embodiment, a system includes an interactive display and processing system operably coupled to the interactive display. The processing system is configured to receive a passenger request to reserve an elevator car of an elevator system to travel to a targeted destination. At least two different travel options to the targeted destination are determined based on a plurality of elevator car travel plans comprising at least two elevator cars having different travel ranges. The at least two different travel options are output to an interactive display. At least one of the at least two elevator cars is reserved responsive to a user selection of one of the at least two different travel options.

Technical effects of embodiments of the present disclosure include providing an elevator car route selector to present and adjust elevator car dispatching options.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
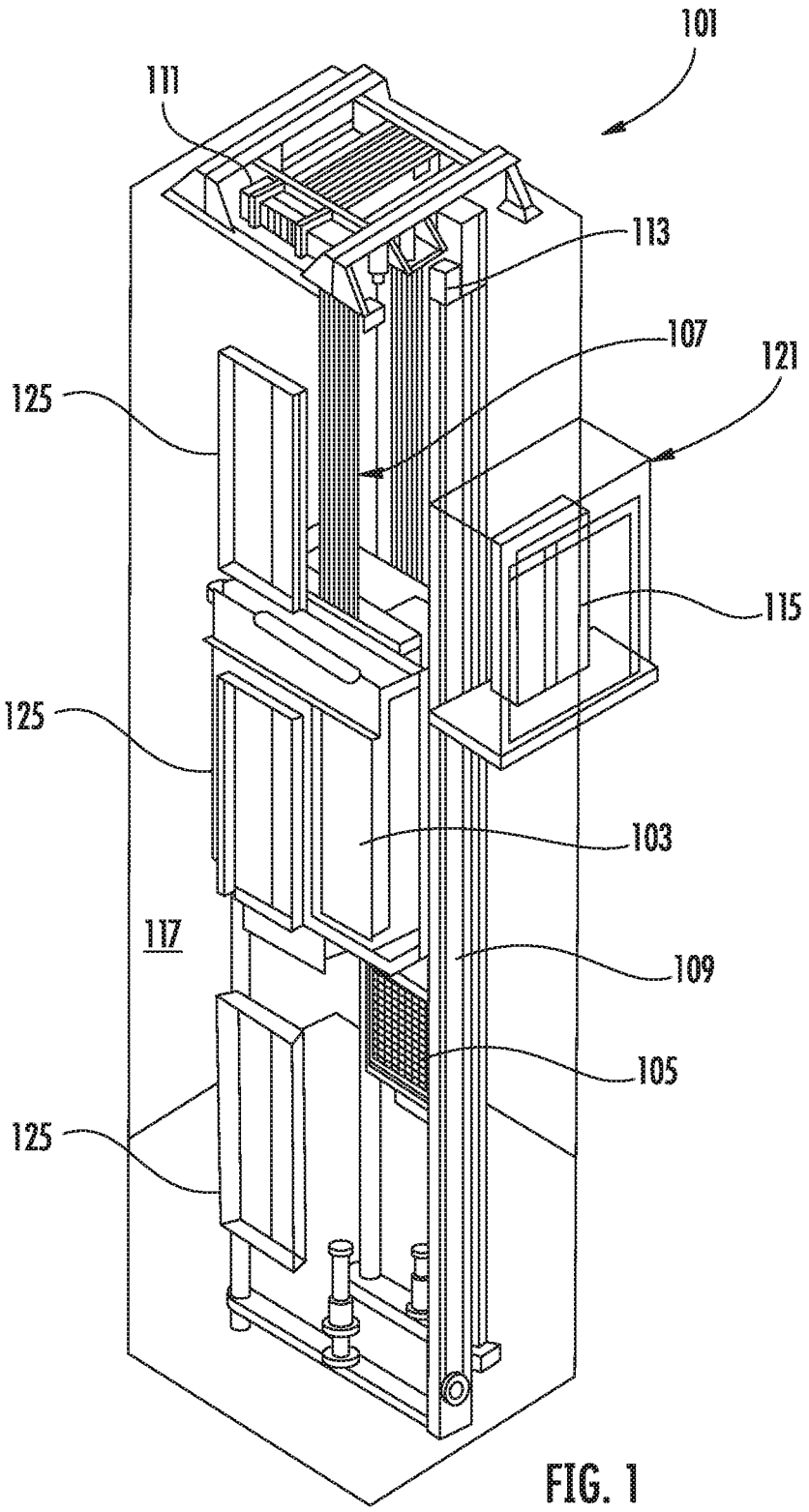
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
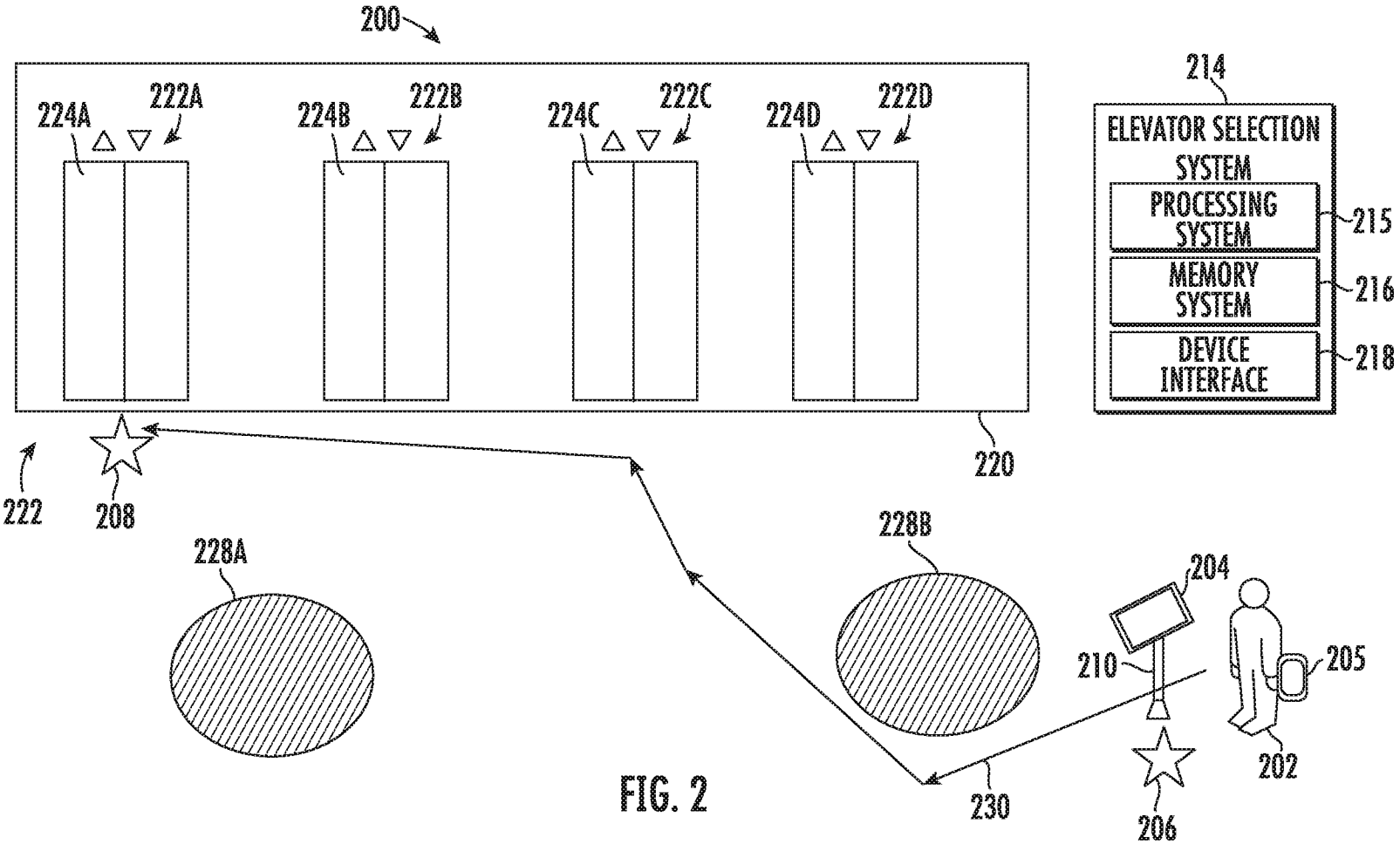
FIG. 2 is a schematic illustration of a multi-car elevator system with route selection in accordance with an embodiment of the disclosure.

As shown in FIG. 2, a system 200 for elevator car route selection is illustrated, in accordance with an embodiment of the present disclosure. As seen in FIG. 2, a user 202 (e.g., a potential passenger) can view and interact with an interactive display 204 (e.g., a computer monitor) prior to transitioning between a location 206 proximate to the interactive display 204 and an elevator entry point 208. The interactive display 204 can be a kiosk 210 in a substantially fixed position that is viewable by the user 202 at the location 206. In some embodiments, display content to be displayed on the interactive display 204 includes travel options and directions in text and/or graphic form to assist the user 202 in navigating through a building to a targeted destination on a different floor.

The example of FIG. 2 is an elevator lobby 220 that includes multiple elevator access points 222A, 222B, 222C, 222D (generally, 222). Each of the elevator access points 222A, 222B, 222C, 222D can be associated with a set of elevator doors 224A, 224B, 224C, 224D. There may be various impediments for the user 202 to travel between the location 206 proximate to the interactive display 204 and the elevator entry point 208, such as objects 228A, 228B. The objects 228A, 228B are examples of path movement constraints (e.g., furniture, support columns, various structures, etc.) that limit the likely future position of the user 202. Given that the elevator entry point 208 is one of the elevator access points 222 in FIG. 2, the objects 228A, 228B may limit the movement options of the user 202 and impact total travel time, for instance, such that the user 202 is most likely to pass between the objects 228A, 228B along a travel path 230 of the user 202. The elevator access points 222 may be associated with elevator cars 103 (FIG. 1) having different travel ranges within the building.

An elevator selection system 214 can be incorporated into or operably coupled to the interactive display 204 and/or the one or more systems, such as a mobile device 205, in a local, remote, networked, or distributed configuration. The elevator selection system 214 can include a processing system 215, a memory system 216, and a device interface 218. The processing system 215 may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory system 216 may be a storage device such as, for example, a random access memory (RAM), read only memory (ROM), or other electronic, optical, magnetic or any other computer readable storage medium. The memory system 216 can include computer-executable instructions that, when executed by the processing system 215, cause the processing system 215 to perform operations as further described herein. The device interface 218 can include wired, wireless, and/or optical communication links to the interactive display 204, the controller 115 of FIG. 1, and/or the mobile device 205. Although only a single instance of the elevator selection system 214 is depicted in FIG. 2, it will be understood that there can be multiple instances of the elevator selection system 214 and/or multiple instances of the interactive display 204 to enable multiple users to select travel routes in parallel.

The mobile device 205 may be a mobile computing device that is typically carried by a person (e.g., user 202), such as, for example a smart phone, PDA, smart watch, tablet, laptop, etc. The mobile device 205 can include an application operable to interface with the device interface 218 of the elevator selection system 214. In some embodiments, the mobile device 205 can provide the similar or a same user interface as accessible through the interactive display 204. The mobile device 205 may also receive and display status updates as the user 202 progresses towards a targeted destination. A location of the mobile device 205 may be determined using various technologies including GPS, WiFi, RFID, Bluetooth, triangulation, trilateration, signal strength detection, accelerometer detection, gyroscopic detection, or other known techniques by way of non-limiting example.

Figure 3:
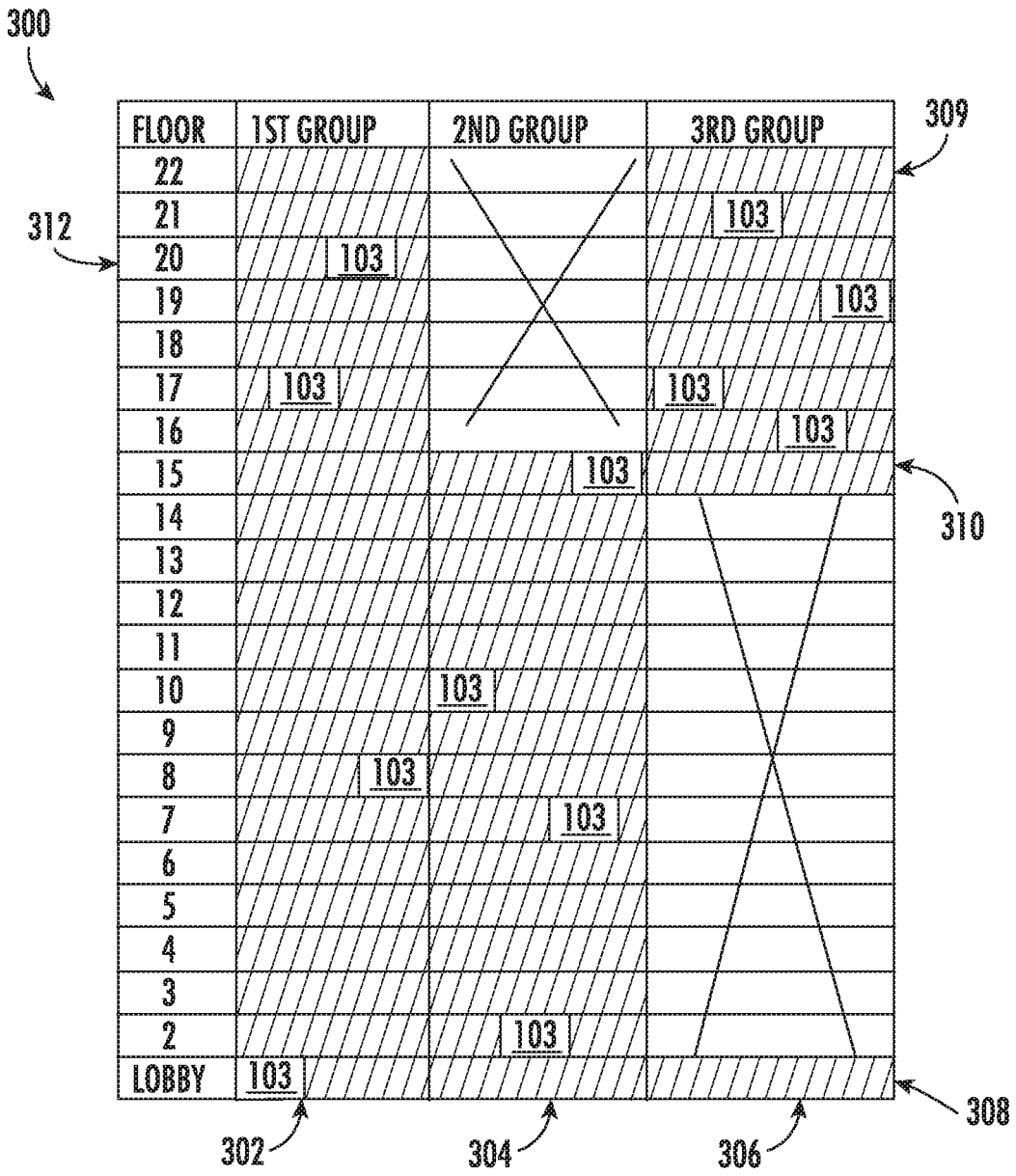
FIG. 3 is a schematic illustration of elevator car groups having different travel ranges that may employ various embodiments of the disclosure.

FIG. 3 illustrates a plurality of elevator car groups 300 having different travel ranges. A first group 302 may include one or more elevator cars 103 operable to travel from a lower lobby floor 308 (e.g., a ground floor) to an uppermost floor 309 and any desired floors in between. A second group 304 may include one or more elevator cars 103 operable to travel between the lower lobby floor 308 and a transfer floor 310 (also referred to as a sky lobby floor) and any desired floors in between. Notably, elevator cars 103 of the second group 304 cannot directly reach the uppermost floor 309. A third group 306 of one or more elevator cars 103 can travel from the lower lobby floor 308 to transfer floor 310, while skipping floors 2-14. The third group 306 can also travel between the transfer floor 310 and the uppermost floor 309, stopping at any desired floors in between. In some embodiments, the third group 306 may not be accessible at the lower lobby floor 308. To reach a targeted destination 312 above the transfer floor 310, the user 202 of FIG. 2 may take an elevator car 103 of the first group 302 from the lower lobby floor 308 directly to the targeted destination 312 or can switch from the second group 304 to the third group 306 on the transfer floor 310. Depending on a travel speed of the first group 302 and a number of planned stops, a travel route on the second group 304 and the third group 306 may be faster than remaining in one of the elevator cars 103 of the first group 302. Although the example of FIG. 3 depicts three groups 302, 304, 306, it will be understood that any number of elevator groups can be defined where each group includes at least one elevator car 103. Elevator groups can enable travel to any desired continuous or non-continuous number of floors. Further, the groups 302-306 need not be next to each other but may be spread apart within the same structure. Further, additional conveyance means may be included within a given route to reach the targeted destination 312, such as stairs, escalators, moving walkways, shuttles, and the like.

Figure 4:
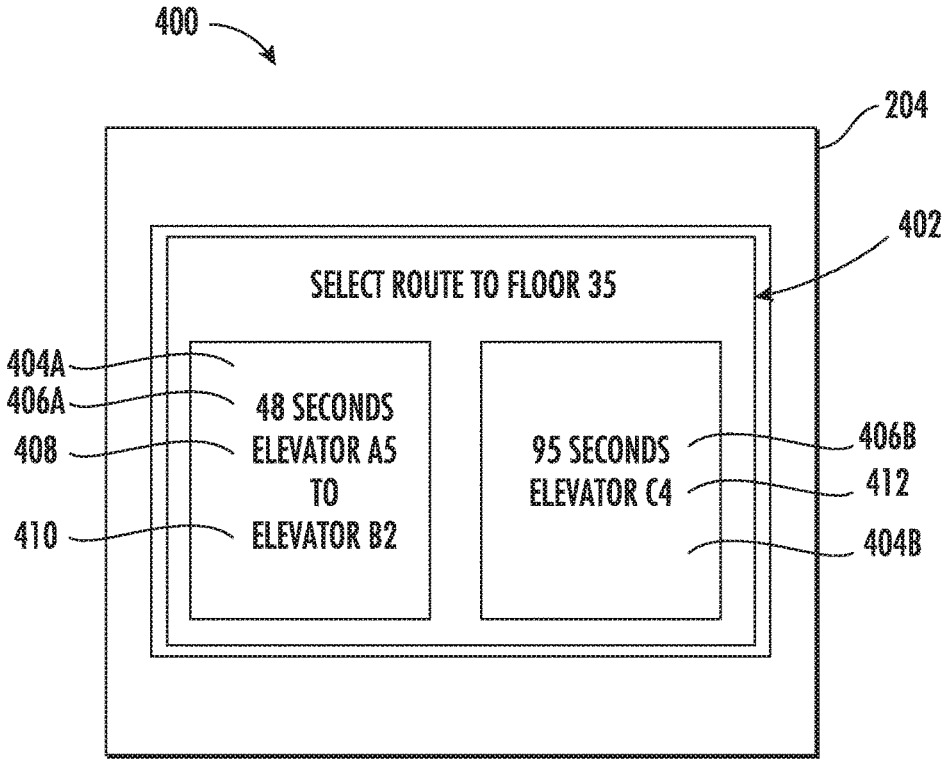
FIG. 4 is a schematic illustration of a user interface on an interactive display in accordance with an embodiment of the disclosure.

FIG. 4 illustrates an example of a user interface 400 that can be displayed on the interactive display 204. For instance, the user interface 400 can display a prompt 402 that identifies the targeted destination 312 as previously selected. The at least two different travel options 404A, 404B can be output on the interactive display 204. Each of the travel options 404A, 404B can include an estimated travel time and route details. For example, travel option 404A includes an estimated travel time 406A, and a travel route that includes a first elevator car 408 and a second elevator car 410. The first elevator car 408 (e.g., elevator A5) may be one of the elevator cars 103 of the second group 304 of FIG. 3, while the second elevator car 410 (e.g., elevator B2) may be one of the elevator cars 103 of the third group 306 of FIG. 3. The first estimated travel time 406A can include an expected transition time to travel from the second group 304 to the third group 306 on the transfer floor 310 of FIG. 3. The travel option 404B can include an estimated travel time 406B and a third elevator car 412 (e.g., elevator C4), which may be one of the elevator cars 103 of the first group 302 of FIG. 3. Notably, in this example, the first estimated travel time 406A is less than the second estimated travel time 406B even though the route of travel option 404A includes a transfer between first and second elevator cars 408, 410, while travel option 404B includes no transfers (only the third elevator car 412). Thus, the user 202 of FIG. 2 can select between a faster route or a less complex route.

Upon selecting one of the travel options 404A, 404B, the elevator selection system 214 of FIG. 2 can update associated travel plans of one or more of the elevator cars 103 included in the selected route. For example, if travel option 404A included one stop at floor 6 by the first elevator car 408 prior to reaching the transfer floor 310 and one stop on floor 17 by the second elevator car 410 between the transfer floor 310 prior to reaching the targeted destination 312 (e.g., on floor 35 in this example), the travel plan of the first elevator car 408 can remain unchanged (e.g., assuming the first elevator car 408 already has a stop at transfer floor 310) and the travel plan of the second elevator car 410 can be modified to add a stop at floor 35 to reach the targeted destination 312. Similarly, if the travel plan of the third elevator car 412 included stops at floors 4, 8, 10, 17, and 20, the selection of travel option 404B can modify the travel plan of the third elevator car 412 to add the targeted destination 312 (e.g., on floor 35 in this example). If the targeted destination 312 is already part of the travel plan, then an adjustment may include a longer delay at the targeted destination 312 to ensure adequate time for multiple passengers to disembark. Time estimates can include a number of factors, such as an amount of time for the elevator cars 103 to initially reach the loading floor (e.g., lower lobby floor 308 of FIG. 3), expected walking time, expected delays at each stopping floor, anticipated delays due to time of day/congestion, and other such factors.

Figure 5:
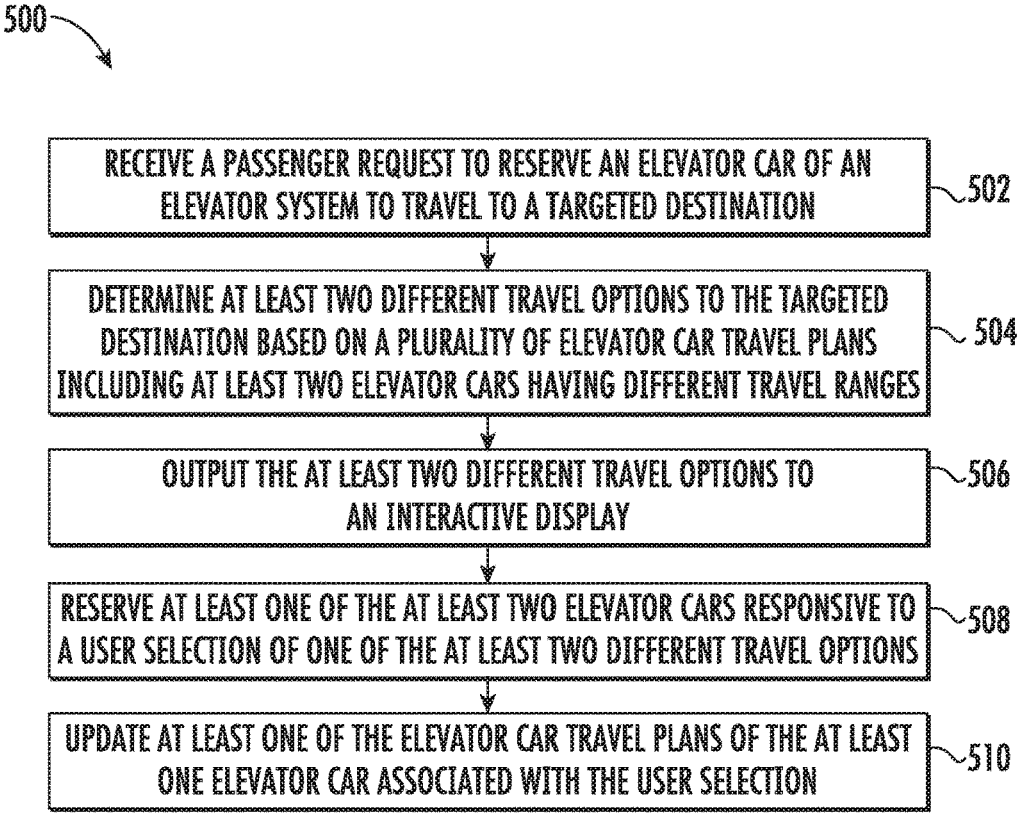
FIG. 5 is a flow chart of a method in accordance with an embodiment of the disclosure.

Referring now to FIG. 5, while referencing FIGS. 1-4, FIG. 5 shows a flow chart of a method 500 in accordance with an embodiment of the disclosure. At block 502, the elevator selection system 214 receives a passenger request to reserve an elevator car 103 of an elevator system 101 to travel to a targeted destination 312. In some embodiments, the passenger request is received through the interactive display 204 at a kiosk 210. Alternatively, the passenger request may be received through a mobile device 205.

At block 504, the elevator selection system 214 determines at least two different travel options 404A, 404B to the targeted destination 312 based on a plurality of elevator car travel plans including at least two elevator cars 103 having different travel ranges (e.g., selected from groups 302-306). The elevator car travel plans can include a list of planned stops, stop times, travel times, and a number of passengers expected to enter and exit at each of the planned stops. The at least two different travel options 404A, 404B can be identified based on minimizing one or more changes to estimated travel times provided to one or more previously reserved passengers. Thus, once a user 202 makes a selection of a travel option 404A, 404B, the elevator selection system 214 attempts to maintain the estimated travel time 406A, 406B by avoiding inclusion of additional stops by subsequent passengers prior to the user 202 reaching the targeted destination 312.

At block 506, the elevator selection system 214 outputs the at least two different travel options 404A, 404B to an interactive display 204. The different travel options 404A, 404B may also or alternatively be output to the mobile device 205 associated with the user 202.

At block 508, the elevator selection system 214 can reserve at least one of the at least two elevator cars 103 responsive to a user selection of one of the at least two different travel options 404A, 404B. Thus, if travel option 404B is selected, the third elevator car 412 is reserved with a spot for the user 202, but if travel option 404A is selected then the first and second elevator cars 408, 410 are reserved with a spot for the user 202.

At block 510, the elevator selection system 214 can update at least one of the elevator car travel plans of the at least one elevator car 103 associated with the user selection. Elevator car travel plans can be managed by the elevator selection system 214 or by another supervisory system, with specific elevator car travel plans provided to an associated instance of the controller 115.

In embodiments, the elevator selection system 214 can determine an estimated travel time 406A, 406B for each of the at least two different travel options 404A, 404B based on the elevator car travel plans. The elevator selection system 214 can output the estimated travel time 406A, 406B for each of the at least two different travel options 404A, 404B to the interactive display 204 and/or the mobile device 205. The estimated travel time 406A, 406B can be a route travel time that incorporates an estimated transfer time between two or more of the elevator cars 103 on a transfer floor 310. The estimated travel time 406A, 406B can incorporate an estimated travel time from the interactive display 204 (e.g., at location 206) to an elevator entry point 208 for each of the at least two different travel options 404A, 404B. The estimated travel time 406A, 406B can incorporate an estimated arrival time of an elevator car 103 at an elevator entry point 208 for each of the at least two different travel options 404A, 404B.

In some embodiments, to support groups of passengers traveling to the same floor, the elevator selection system 214 can prompt for a user input of a number of passengers associated with the passenger request. The elevator selection system 214 can select the at least two different travel options 404A, 404B based on an expected capacity to accommodate the number of passengers.

The elevator selection system 214 can transfer a sequence of instructions to a mobile device 205 associated with the passenger request based on the user selection of one of the at least two different travel options 404A, 404B. An estimated arrival time at the targeted destination 312 on the mobile device 205 as a user 202 of the mobile device 205 progresses. An application of the mobile device 205 can compute the estimated arrival time based on data from the elevator selection system 214 and position information of the mobile device 205. Alternatively, the elevator selection system 214 may track progress of the mobile device 205 along a selected route and send updates to the estimated arrival time to the mobile device 205.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method comprising:

receiving a passenger request to reserve an elevator car of an elevator system to travel to a targeted destination;

determining at least two different travel options to the targeted destination based on a plurality of elevator car travel plans comprising at least two elevator cars having different travel ranges;

outputting the at least two different travel options to an interactive display; and reserving at least one of the at least two elevator cars responsive to a user selection of one of the at least two different travel options, wherein the at least two different travel options are identified based on minimizing one or more changes to estimated travel times provided to one or more previously reserved passengers.

2. The method of claim 1, further comprising:

determining an estimated travel time for each of the at least two different travel options; and outputting the estimated travel time for each of the at least two different travel options to the interactive display.

3. The method of claim 2, wherein the estimated travel time is a route travel time that incorporates an estimated transfer time between two or more of the elevator cars on a transfer floor.

4. The method of claim 3, wherein the estimated travel time incorporates an estimated travel time from a data entry location to an elevator entry point for each of the at least two different travel options.

5. The method of claim 3, wherein the estimated travel time incorporates an estimated arrival time of an elevator car at an elevator entry point for each of the at least two different travel options.

6. A method comprising:

receiving a passenger request to reserve an elevator car of an elevator system to travel to a targeted destination;

prompting for a user input of a number of passengers associated with the passenger request;

determining at least two different travel options to the targeted destination based on a plurality of elevator car travel plans comprising at least two elevator cars having different travel ranges;

selecting the at least two different travel options based on an expected capacity to accommodate the number of passengers;

outputting the at least two different travel options to an interactive display; and reserving at least one of the at least two elevator cars responsive to a user selection of one of the at least two different travel options.

7. The method of claim 1, further comprising:

transferring a sequence of instructions to a mobile device associated with the passenger request based on the user selection of one of the at least two different travel options; and updating an estimated arrival time at the targeted destination on the mobile device as a user of the mobile device progresses.

8. The method of claim 1, further comprising:

updating at least one of the elevator car travel plans of the at least one elevator car associated with the user selection.

9. A method comprising:

receiving a passenger request to reserve an elevator car of an elevator system to travel to a targeted destination;

determining at least two different travel options to the targeted destination based on a plurality of elevator car travel plans comprising at least two elevator cars having different travel ranges, wherein the elevator car travel plans comprise a list of planned stops, stop times, travel times, and a number of passengers expected to enter and exit at each of the planned stops;

outputting the at least two different travel options to an interactive display; and reserving at least one of the at least two elevator cars responsive to a user selection of one of the at least two different travel options.

10. The method of claim 1, wherein the at least two different travel options are identified based on anticipated delays due to time of day/congestion.

11. A system comprising:

an interactive display; and a processing system operably coupled to the interactive display and configured to perform:

receiving a passenger request to reserve an elevator car of an elevator system to travel to a targeted destination;

determining at least two different travel options to the targeted destination based on a plurality of elevator car travel plans comprising at least two elevator cars having different travel ranges;

outputting the at least two different travel options to the interactive display; and reserving at least one of the at least two elevator cars responsive to a user selection of one of the at least two different travel options, wherein the at least two different travel options are identified based on minimizing one or more changes to estimated travel times provided to one or more previously reserved passengers.

12. The system of claim 11, wherein the processing system is configured to perform:

determining an estimated travel time for each of the at least two different travel options; and outputting the estimated travel time for each of the at least two different travel options to the interactive display.

13. The system of claim 12, wherein the estimated travel time is a route travel time that incorporates an estimated transfer time between two or more of the elevator cars on a transfer floor.

14. The system of claim 13, wherein the estimated travel time incorporates an estimated travel time from a data entry location to an elevator entry point for each of the at least two different travel options.

15. The system of claim 13, wherein the estimated travel time incorporates an estimated arrival time of an elevator car at an elevator entry point for each of the at least two different travel options.

16. The system of claim 11, wherein the processing system is configured to perform:

prompting for a user input of a number of passengers associated with the passenger request; and selecting the at least two different travel options based on an expected capacity to accommodate the number of passengers.

17. The system of claim 11, wherein the processing system is configured to perform:

transferring a sequence of instructions to a mobile device associated with the passenger request based on the user selection of one of the at least two different travel options; and updating an estimated arrival time at the targeted destination on the mobile device as a user of the mobile device progresses.

18. The system of claim 11, wherein the processing system is configured to perform:

updating at least one of the elevator car travel plans of the at least one elevator car associated with the user selection.

19. The system of claim 11, wherein elevator car travel plans comprise a list of planned stops, stop times, travel times, and a number of passengers expected to enter and exit at each of the planned stops.

20. The system of claim 11, wherein the at least two different travel options are identified based on anticipated delays due to time of day/congestion.

* * * * *